US005080069A

United States Patent [19]

Hudson, Jr.

[11] Patent Number: 5,080,069

[45] Date of Patent: Jan. 14, 1992

[54] FUEL RAIL WITH INTERNAL FILTER

[75] Inventor: Sharon J. Hudson, Jr., Lambertville, Mich.

[73] Assignee: Sharon Manufacturing Company, a division of Walbro Corporation, Lambertville, Mich.

[21] Appl. No.: 658,954

[22] Filed: Feb. 22, 1991

[51] Int. Cl.[5] ..... F02M 55/02

[52] U.S. Cl. ..... 123/456; 123/470; 239/575

[58] Field of Search ..... 123/456, 467, 468, 469, 123/420, 472; 239/104, 575; 210/435, 449, 460, 462, 467

[56] References Cited

U.S. PATENT DOCUMENTS

| | | | |
|---|---|---|---|
| 2,207,294 | 7/1940 | Hubner et al. | 210/467 |
| 3,125,078 | 3/1964 | Reiners | 123/468 |
| 3,695,450 | 10/1972 | Lieberman | 210/449 |
| 4,000,857 | 1/1977 | Moen | 239/575 |
| 4,290,888 | 9/1981 | Gartmann et al. | 210/435 |
| 4,453,671 | 6/1984 | Hafner | 239/575 |
| 4,474,160 | 10/1984 | Gartner | 123/468 |
| 4,503,826 | 3/1985 | Kessler et al. | 123/470 |
| 4,519,368 | 5/1985 | Hudson, Jr. | 123/468 |
| 4,604,202 | 8/1986 | Movshovitz | 210/449 |
| 4,861,478 | 8/1989 | Hall | 210/460 |
| 4,905,651 | 3/1990 | Bonfiglioli et al. | 123/470 |
| 4,924,834 | 5/1990 | Bonfiglioli et al. | 123/470 |
| 4,981,586 | 1/1991 | Bartholomew | 210/435 |

FOREIGN PATENT DOCUMENTS

| | | | |
|---|---|---|---|
| 0379777 | 8/1973 | U.S.S.R. | 123/468 |

*Primary Examiner*—E. Rollins Cross
*Assistant Examiner*—Thomas N. Moulis
*Attorney, Agent, or Firm*—Harold F. Mensing

[57] ABSTRACT

A fuel rail assembly for distributing fuel to a plurality of electromagnetic fuel injectors which in turn supply atomized fuel to the cylinders of an internal combustion engine. Each of the injectors has a fuel inlet section that is removably held in an injector socket in the rail. Inside the rail a filter member, having a relatively large surface area, is provided at each injector socket to filter only that porton of the fuel which flows into its respective socket immediately prior to the entry of the fuel into the socket. The injector sockets and the filter members are designed so they have mating cylindrical sections which allow the filter members to be telescoped over the corresponding cylindrical sections of the sockets. Each filter member has a dome section which covers a fuel inlet aperture in the socket. The dome section extends from the cylindrical section into an open space above it where the apex of the dome abuts another member of the rail assembly thereby holding the filter member in place.

11 Claims, 2 Drawing Sheets

FUEL RAIL WITH INTERNAL FILTER

BACKGROUND OF THE INVENTION

This invention relates to a fuel rail containing a plurality of electromagnetic fuel injectors for supplying fuel to respective cylinders of an internal combustion engine. More specifically, it relates to such a fuel rail having an internal fuel filtering member at each injector site.

It is well known that small particles of rust, scale, dirt or debris carried by the fuel can interfere with the efficient operation of fuel injectors or even cause permanent damage to them, if such particles are allowed to enter the fuel injector mechanism. Efforts have been made in the past to filter such particles out of the fuel before it enters the fuel rail. Although these prior art systems greatly reduced the hazard, they had at least one weakness. Namely, they could do nothing about particles contained in that portion of the system lying downstream from the filter. For example, loose particles which entered or were contained in the downstream section components of the fuel system prior to installation or that were produced therein during subsequent use. To further alleviate the problem, each injector was provided with its own internal filter. This helped but, because the filter inside the injector was necessarily of very limited size, it was subject to becoming clogged by only a small amount of debris. Accordingly, it is a general object of this invention to provide a fuel rail with an internal filter means having a filter member adjacent to each injector site for filtering out particulate contaminates immediately prior to the fuel entering the injector. It is another object of this invention to provide a relatively large area filter member that is dedicated to filtering only that portion of the fuel which is being conducted to its respective injector. It is yet another object to provide such a filter means with a vertically disposed self cleaning surface. It is still another object to provide a fuel rail structure in which the filter means is held in position around a fuel injector receptacle or socket by adjoining components and thus does not require an additional attachment means.

SUMMARY OF THE INVENTION

The fuel rail assembly of this invention comprises top and bottom rail sections sealingly joined together face-to-face to form a tubular rail member. Fuel injector sockets or receptacles for removably holding the fuel inlet portions of the injectors are disposed at intervals along the rail member. The sockets have upright internally projecting annular collar sections around which the open ends of hat shaped filter elements are snugly fitted. The fuel rail components are designed so that the filter elements are held in position by an adjoining section of the rail assembly, such as the top section of the rail or an intermediate divider, which bears against the crown portion of the filter member. The above structure utilizes self-cleaning filter members having relatively large cross sectional areas located at the injector sites of the fuel rail. Each filter member filters only that portion of the fuel which enters its respective injector socket and does so immediately prior to the entry of the fuel therein.

These features and other details and relationships as well as their advantages will be understood best if the following description is read in conjunction with the accompanying drawings wherein similar elements are given similar reference numerals.

DETAILED DESCRIPTION OF THE INVENTION

Figure 2:
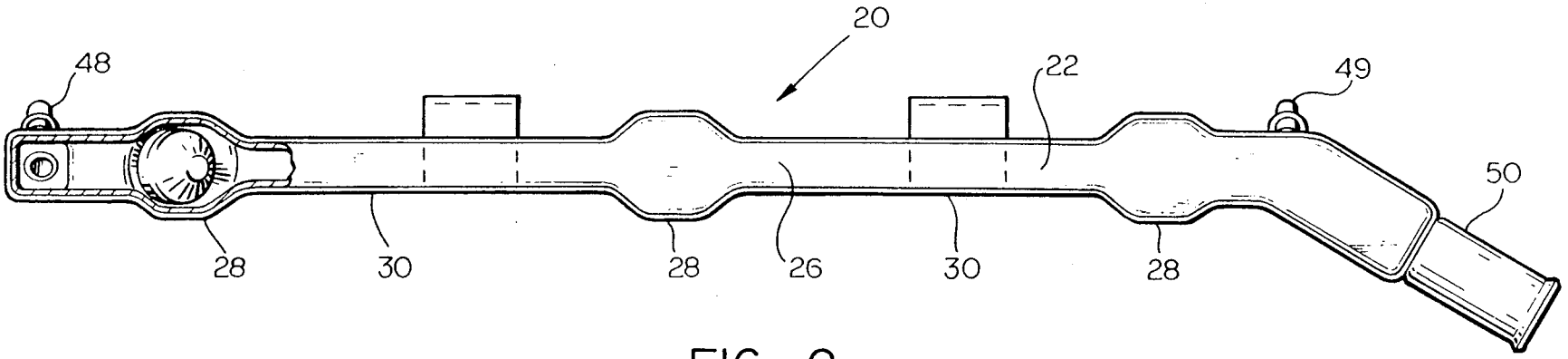
FIG. 2 is a plan view of FIG. 1 with top portions broken away at one end to show additional internal details.
Figure 1:
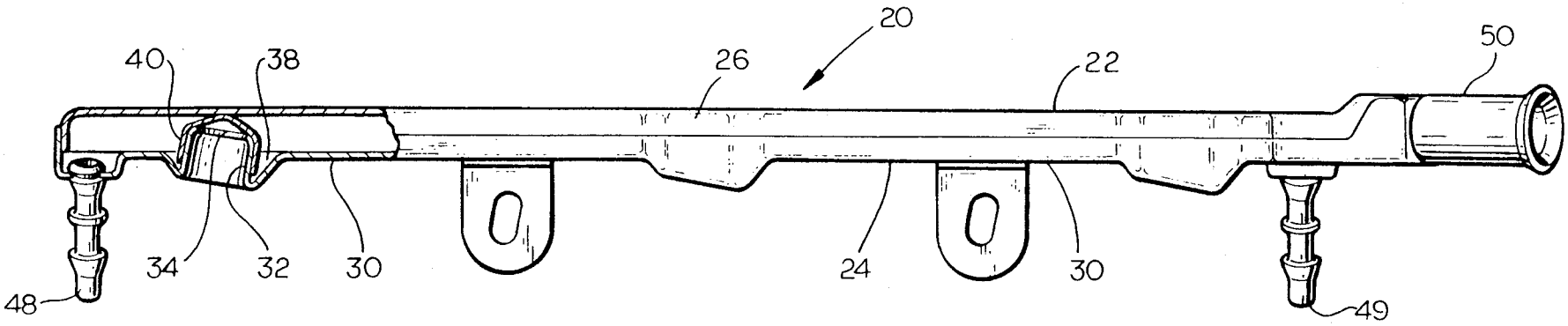
FIG. 1 is a side view of a fuel rail assembly embodiment made in accordance with the teachings of this invention with side portions broken away at one end to show internal details of an injector socket with its associated filter member.
Figure 3:
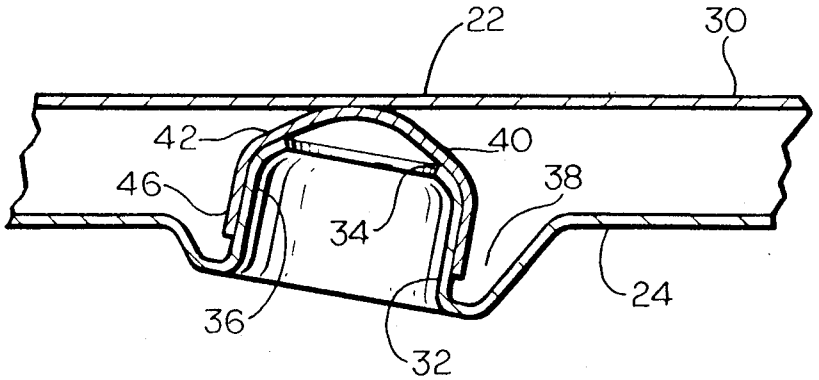
FIG. 3 is an enlarged fragmentary sectional side view of an injector socket and filter member of the fuel rail assembly shown in FIG. 1.

The fuel rail assembly embodiment 20 illustrated in FIGS. 1–3 of the drawings is only one of a pair of fuel rail assemblies required for a V-6 engine. For the sake of brevity the other rail assembly was omitted. It is essentially the same as the illustrated one and thus is unnecessary for an understanding of this invention. Fuel rail assembly 20 has an elongated top member 22 and a mating bottom member 24 formed from sheet metal by stamping processes. Both may have generally U-shaped cross sections so that when they are assembled together in a confronting relationship, rather than end-to-end, the sides of one overlap the sides of the other. The top 22 and bottom 24 members are sealingly bonded together to form a tubular rail, such as by furnace brazing. Preferably, the rail portion 26 of fuel rail assembly 20 is formed so as to have a plurality of bulbous or nodular sections 28 connected in series by intermediate arterial sections 30 of lesser cross sectional size.

Electromagnetic fuel injector receptacles or sockets 32 for holding the fuel inlet portions of the injectors (injectors not shown) may be formed directly in the bottom member 24, as exemplified in the drawings, or they may be produced as separate parts and attached to the bottom member. In either case the sockets have fuel inlet apertures 34 and are provided with cylindrical sections 36 which project into the interior of the rail. Preferably, each of the sockets 32 also has an annular well or depression 38 surrounding the base of the its cylindrical section 36.

A filter member 40 is provided at each injector site to cover the respective fuel inlet aperture on the upstream side thereof and prevent particulate matter from entering the injector socket. Preferably, each filter member 40 has a cylindrical base section 46 with an open bottom end and a closed crown or dome section 42 extending upwardly from the other end thereof. The cylindrical base sections 46 are fitted over corresponding cylindrical socket sections 36 and support the dome sections over the fuel inlet apertures 34. This arrangement provides vertically disposed or inclined self cleaning filter surfaces which allow particles that are filtered out of the fuel to gravitate down the inclined surfaces into the surrounding annular wells or depressions 38. The filter members 40 are held in position on the sockets by bringing the top rail member into position against the apices of the dome sections 42 during final assembly.

Crossover fitments 48, 49 for attaching flexible crossover tubes may be mounted adjacent to each end of the rail to provide fluid communication between this fuel rail assembly and another similar rail assembly of a pair required for a V-6 or V-8 engine. A fuel supply line connector 50 is mounted at one end of the rail.

Figure 4:
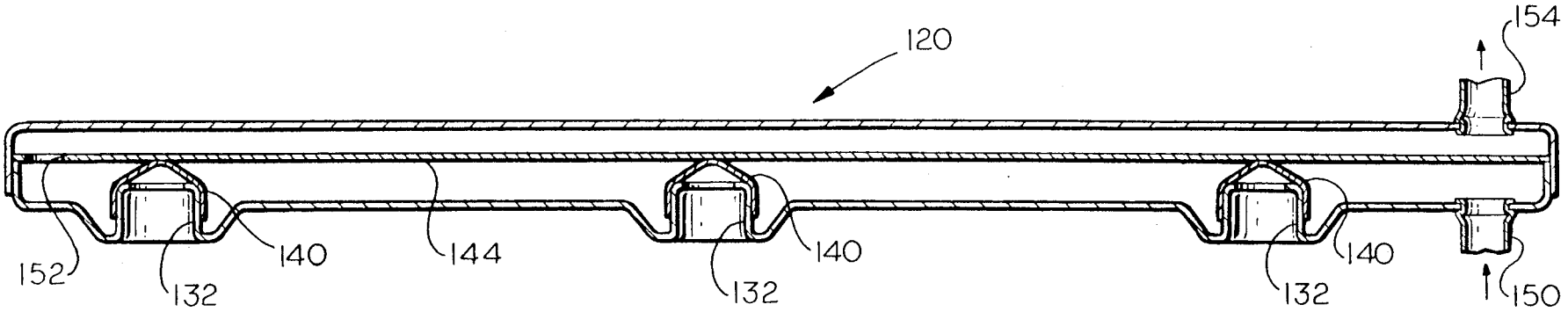
FIG. 4 is a sectional side view taken in a plane containing the axes of the injector sockets of another fuel rail assembly embodiment.

The fuel injector rail assembly embodiment 120 shown in FIG. 4 also has internal filter members at each injector site. The filter members 140 have the same hat shaped configuration as the previously described filter members 40. However, in the instant embodiment 120 the axes of the injector sockets 132 are perpendicular to the rail axis rather than being tilted with respect thereto as were the sockets 32 of embodiment 20. Another significant difference is that fuel rail assembly 120 has an internal divider 144 which separates the inside of the rail into upper and lower fuel runs. It is the internal divider that bears against the apices of the filter members 140 and holds them in place on their respective sockets 132. Fuel enters the rail through a supply line fitment 150 at one end of the rail and flows along the lower run to the opposite end thereof where it travels through aperture 152 in the divider into the upper run. From there it flows in the opposite direction back to the first end of the rail where it exits through a return line fitment 154.

Although the invention has been described specifically with respect to two of its presently preferred embodiments, it is to be understood that various modifications could be made to the embodiments illustrated and described herein without departing from the scope of the invention as defined by the following claims.

What is claimed is:

1. A fuel injection rail assembly for supplying fuel to a plurality of electromagnetic fuel injectors of an internal combustion engine, said assembly comprising: a tubular rail member having an elongated top section and a similarly elongated confronting bottom section, said sections being sealingly joined together, a plurality of spaced apart fuel injector sockets each for holding therein a fuel inlet portion of a respective electromagnetic fuel injector, said sockets being disposed seriately along said rail member, an aperture in each of said sockets for supplying fuel to said injectors from inside said rail member, and a filter member mounted on the upstream side of and covering each of said socket apertures.

2. A fuel injector rail assembly according to claim 1 wherein each of said sockets has a cylindrical section projecting into the interior of said rail member.

3. A fuel injection rail assembly according to claim 2 wherein said filter member has a corresponding cylindrical side section surrounding said projecting cylindrical section and a crown section extending inwardly beyond the inner end of said projecting section.

4. A fuel injection rail assembly according to claim 3 wherein said crown section abuts an opposing surface of one of said rail members.

5. A fuel injection rail assembly according to claim 3 wherein said rail member further includes an internal divider which divides the inside of said tubular rail member into an upper fuel run and a lower fuel run, and wherein said crown section abuts an opposing surface of said divider.

6. A fuel injection rail assembly according to claim 3 wherein said crown section is in the shape of a dome.

7. A fuel injection rail assembly according to claim 2 wherein each injector socket is provided with an annular depression which extends around the base of said projecting section.

8. A fuel injection rail assembly for supplying fuel to a plurality of electromagnetic fuel injectors of an internal combustion engine, said assembly comprising: a tubular rail member having an elongated top section and a similarly elongated confronting bottom section, said sections being sealingly joined together, a plurality of spaced apart fuel injector sockets each for holding therein a fuel inlet portion of a respective electromagnetic fuel injector, said sockets being disposed seriately along said rail member, each of said sockets having a cylindrical section projecting into the interior of said rail member, an aperture in each of said sockets for supplying fuel to said injectors from inside said rail member, and a filter member mounted on the upstream side of and covering each of said socket apertures, said filter member having a corresponding cylindrical side section and a crown section extending beyond the inner end of said projecting section, said crown section being in an abutting relationship with an opposing surface of one of said rail members.

9. A fuel injection rail assembly according to claim 8 wherein said rail member further includes an internal divider which divides the inside of said tubular rail member into an upper fuel run and a lower fuel run, and wherein said crown section abuts an opposing surface of said divider.

10. A fuel injection rail assembly according to claim 8 wherein said crown section is in the shape of a dome.

11. A fuel injection rail assembly according to claim 8 wherein each injector socket is provided with an annular depression which extends around the base of said projecting section.

* * * * *